United States Patent [19]

Kukes et al.

[11] Patent Number: 4,612,110

[45] Date of Patent: Sep. 16, 1986

[54] HYDROFINING PROCESS FOR HYDROCARBON CONTAINING FEED STREAMS

[75] Inventors: Simon G. Kukes; Thomas Davis; Howard F. Efner; Robert J. Hogan; Daniel M. Coombs, all of Bartlesville, Okla.

[73] Assignee: Phillips Petroleum Company, Bartlesville, Okla.

[21] Appl. No.: 589,362

[22] Filed: Mar. 14, 1984

Related U.S. Application Data

[63] Continuation-in-part of Ser. No. 540,597, Oct. 11, 1983, abandoned.

[51] Int. Cl.[4] ..... C10G 45/08; C10G 47/12; C10G 49/04

[52] U.S. Cl. ..... 208/251 H; 208/112; 208/216 R; 208/217; 208/108

[58] Field of Search ..... 208/216 R, 251 H, 254 H, 208/108, 112, 217; 502/521

[56] References Cited

U.S. PATENT DOCUMENTS 4,243,553 1/1981 Naumann et al. ..... 502/220

*Primary Examiner*—D. E. Gantz
*Assistant Examiner*—O. Chaudhuri
*Attorney, Agent, or Firm*—French and Doescher

[57] ABSTRACT

At least one decomposable molybdenum dithiocarbamate compound is mixed with a hydrocarbon-containing feed stream. The hydrocarbon-containing feed stream containing such decomposable molybdenum dithiocarbamate compound is then contacted in a hydrofining process with a catalyst composition comprising a support selected from the group consisting of alumina, silica and silica-alumina and a promoter comprising at least one metal selected from Group VIB, Group VIIB and Group VIII of the Periodic Table. The introduction of the decomposable molybdenum dithiocarbamate compound may be commenced when the catalyst is new, partially deactivated or spent with a beneficial result occurring in each case.

23 Claims, No Drawings

HYDROFINING PROCESS FOR HYDROCARBON CONTAINING FEED STREAMS

This application is a continuation-in-part of application Ser. No. 540,597 filed Oct. 11, 1983, now abandoned.

This invention relates to a hydrofining process for hydrocarbon-containing feed streams. In one aspect, this invention relates to a process for removing metals from a hydrocarbon-containing feed stream. In another aspect, this invention relates to a process for removing sulfur or nitrogen from a hydrocarbon-containing feed stream. In still another aspect, this invention relates to a process for removing potentially cokeable components from a hydrocarbon-containing feed stream. In still another aspect, this invention relates to a process for reducing the amount of heavies in a hydrocarbon-containing feed stream.

It is well known that crude oil as well as products from extraction and/or liquefaction of coal and lignite, products from tar sands, products from shale oil and similar products may contain components which make processing difficult. As an example, when these hydrocarbon-containing feed streams contain metals such as vanadium, nickel and iron, such metals tend to concentrate in the heavier fractions such as the topped crude and residuum when these hydrocarbon-containing feed streams are fractionated. The presence of the metals make further processing of these heavier fractions difficult since the metals generally act as poisons for catalysts employed in processes such as catalytic cracking, hydrogenation or hydrodesulfurization.

The presence of other components such as sulfur and nitrogen is also considered detrimental to the processability of a hydrocarbon-containing feed stream. Also, hydrocarbon-containing feed streams may contain components (referred to as Ramsbottom carbon residue) which are easily converted to coke in processes such as catalytic cracking, hydrogenation or hydrodesulfurization. It is thus desirable to remove components such as sulfur and nitrogen and components which have a tendency to produce coke.

It is also desirable to reduce the amount of heavies in the heavier fractions such as the topped crude and residuum. As used herein the term heavies refers to the fraction having a boiling range higher than about 1000° F. This reduction results in the production of lighter components which are of higher value and which are more easily processed.

It is thus an object of this invention to provide a process to remove components such as metals, sulfur, nitrogen and Ramsbottom carbon residue from a hydrocarbon-containing feed stream and to reduce the amount of heavies in the hydrocarbon-containing feed stream (one or all of the described removals and reduction may be accomplished in such process, which is generally refered to as a hydrofining process, depending on the components contained in the hydrocarbon-containing feed stream). Such removal or reduction provides substantial benefits in the subsequent processing of the hydrocarbon-containing feed streams.

In accordance with the present invention, a hydrocarbon-containing feed stream, which also contains metals, sulfur, nitrogen and/or Ramsbottom carbon residue, is contacted with a solid catalyst composition comprising alumina, silica or silica-alumina. The catalyst composition also contains at least one metal selected from Group VIB, Group VIIB, and Group VIII of the Periodic Table, in the oxide or sulfide form. At least one decomposable molybdenum dithiocarbamate compound is mixed with the hydrocarbon-containing feed stream prior to contacting the hydrocarbon-containing feed stream with the catalyst composition. The hydrocarbon-containing feed stream, which also contains molybdenum, is contacted with the catalyst composition in the presence of hydrogen under suitable hydrofining conditions. After being contacted with the catalyst composition, the hydrocarbon-containing feed stream will contain a significantly reduced concentration of metals, sulfur, nitrogen and Ramsbottom carbon residue as well as a reduced amount of heavy hydrocarbon components. Removal of these components from the hydrocarbon-containing feed stream in this manner provides an improved processability of the hydrocarbon-containing feed stream in processes such as catalytic cracking, hydrogenation or further hydrodesulfurization. Use of the molybdenum dithiocarbamate compound results in improved removal of metals.

The decomposable molybdenum dithocarbamate compound may be added when the catalyst composition is fresh or at any suitable time thereafter. As used herein, the term "fresh catalyst" refers to a catalyst which is new or which has been reactivated by known techniques. The activity of fresh catalyst will generally decline as a function of time if all conditions are maintained constant. Introduction of the decomposable molybdenum dithiocarbamate compound will slow the rate of decline from the time of introduction and in some cases will dramatically improve the activity of an at least partially spent or deactivated catalyst from the time of introduction.

For economic reasons it is sometimes desirable to practice the hydrofining process without the addition of a decomposable molybdenum dithiocarbamate compound until the catalyst activity declines below an acceptable level. In some cases, the activity of the catalyst is maintained constant by increasing the process temperature. The decomposable molybdenum dithiocarbamate compound is added after the activity of the catalyst has dropped to an unacceptable level and the temperature cannot be raised further without adverse consequences. Addition of the decomposable molybdenum dithiocarbamate compound at this point results in a dramatic increase in catalyst activity as will be illustrated more fully in Example IV.

Other objects and advantages of the invention will be apparent from the foregoing brief description of the invention and the appended claims as well as the detailed description of the invention which follows.

The catalyst composition used in the hydrofining process to remove metals, sulfur, nitrogen and Ramsbottom carbon residue and to reduce the concentration of heavies comprises a support and a promoter. The support comprises alumina, silica or silica-alumina. Suitable supports are believed to be $Al_2O_3$, $SiO_2$, $Al_2O_3$-$SiO_2$, $Al_2O_3$-$TiO_2$, $Al_2O_3$-$BPO_4$, $Al_2O_3$-$AlPO_4$, $Al_2O_3$-$Zr_3(PO_4)_4$, $Al_2O_3$-$SnO_2$ and $Al_2O_3$-ZnO. Of these supports, $Al_2O_3$ is particularly preferred.

The promoter comprises at least one metal selected from the group consisting of the metals of Group VIB, Group VIIB, and Group VIII of the Periodic Table. The promoter will generally be present in the catalyst composition in the form of an oxide or sulfide. Particularly suitable promoters are iron, cobalt, nickel, tungsten, molybdenum, chromium, manganese, vanadium and platinum. Of these promoters, cobalt, nickel, molybdenum and tungsten are the most preferred. A particularly preferred catalyst composition is $Al_2O_3$ promoted by CoO and $MoO_3$ or promoted by CoO, NiO and $MoO_3$.

Generally, such catalysts are commercially available. The concentration of cobalt oxide in such catalysts is typically in the range of about 0.5 weight percent to about 10 weight percent based on the weight of the total catalyst composition. The concentration of molybdenum oxide is generally in the range of about 2 weight percent to about 25 weight percent based on the weight oi the total catalyst composition. The concentration of nickel oxide in such catalysts is typically in the range of about 0.3 weight percent to about 10 weight percent based on the weight of the total catalyst composition. Pertinent properties of four commercial catalysts which are believed to be suitable are set forth in Table I.

TABLE I

| Catalyst | CoO (Wt. %) | MoO (Wt. %) | NiO (Wt. %) | Bulk Density* (g/cc) | Surface Area ($M^2/g$) |
|---|---|---|---|---|---|
| Shell 344 | 2.99 | 14.42 | — | 0.79 | 186 |
| Katalco 477 | 3.3 | 14.0 | — | .64 | 236 |
| KF - 165 | 4.6 | 13.9 | — | .76 | 274 |
| Commercial Catalyst D Harshaw Chemical Company | 0.92 | 7.3 | 0.53 | — | 178 |

*Measured on 20/40 mesh particles, compacted.

The catalyst composition can have any suitable surface area and pore volume. In general, the surface area will be in the range of about 2 to about 400 $m^2/g$, preferably about 100 to about 300 $m^2/g$, while the pore volume will be in the range of about 0.1 to about 4.0 cc/g, preferably about 0.3 to about 1.5 cc/g.

Presulfiding of the catalyst is preferred before the catalyst is initially used. Many presulfiding procedures are known and any conventional presulfiding procedure can be used. A preferred presulfiding procedure is the following two step procedure.

The catalyst is first treated with a mixture of hydrogen sulfide in hydrogen at a temperature in the range of about 175° C. to about 225° C., preferably about 205° C. The temperature in the catalyst composition will rise during this first presulfiding step and the first presulfiding step is continued until the temperature rise in the catalyst has substantially stopped or until hydrogen sulfide is detected in the effluent flowing from the reactor. The mixture of hydrogen sulfide and hydrogen preferably contains in the range of about 5 to about 20 percent hydrogen sulfide, preferably about 10 percent hydrogen sulfide.

The second step in the preferred presulfiding process consists of repeating the first step at a temperature in the range of about 350° C. to about 400° C., preferably about 370° C., for about 2-3 hours. It is noted that other mixtures containing hydrogen sulfide may be utilized to presulfide the catalyst. Also the use of hydrogen sulfide is not required. In a commercial operation, it is common to utilize a light naphtha containing sulfur to presulfide the catalyst.

As has been previously stated, the present invention may be practiced when the catalyst is fresh or the addition of the decomposable molybdenum dithiocarbamate compound may be commenced when the catalyst has been partially deactivated. The addition of the decomposable molybdenum dithiocarbamate compound may be delayed until the catalyst is considered spent.

In general, a "spent catalyst" refers to a catalyst which does not have sufficient activity to produce a product which will meet specifications, such as maximum permissible metals content, under available refinery conditions. For metals removal, a catalyst which removes less than about 50% of the metals contained in the feed is generally considered spent.

A spent catalyst is also sometimes defined in terms of metals loading (nickel+vanadium). The metals loading which can be tolerated by different catalyst varies but a catalyst whose weight has increased about 12% due to metals (nickel+vanadium) is generally considered a spent catalyst.

Any suitable hydrocarbon-containing feed stream may be hydrofined using the above described catalyst composition in accordance with the present invention. Suitable hydrocarbon-containing feed streams include petroleum products, coal, pyrolyzates, products from extraction and/or liquefaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuum. However, the present invention is particularly directed to heavy feed streams such as heavy topped crudes and residuum and other materials which are generally regarded as too heavy to be distilled. These materials will generally contain the highest concentrations of metals, sulfur, nitrogen and Ramsbottom carbon residues.

It is believed that the concentration of any metal in the hydrocarbon-containing feed stream can be reduced using the above described catalyst composition in accordance with the present invention. However, the present invention is particularly applicable to the removal of vanadium, nickel and iron.

The sulfur which can be removed using the above described catalyst composition in accordance with the present invention will generally be contained in organic sulfur compounds. Examples of such organic sulfur compounds include sulfides, disulfides, mercaptans, thiophenes, benzylthiophenes, dibenzylthiophenes, and the like.

The nitrogen which can be removed using the above described catalyst composition in accordance with the present invention will also generally be contained in organic nitrogen compounds. Examples of such organic nitrogen compounds include amines, diamines, pyridines, quinolines, porphyrins, benzoquinolines and the like.

While the above described catalyst composition is effective for removing some metals, sulfur, nitrogen and Ramsbottom carbon residue, the removal of metals can be significantly improved in accordance with the present invention by introducing a suitable decomposable molybdenum dithiocarbamate compound into the hydrocarbon-containing feed stream prior to contacting the hydrocarbon containing feed stream with the catalyst composition. As has been previously stated, the introduction of the decomposable molybdenum dithiocarbamate compound may be commenced when the catalyst is new, partially deactivated or spent with a beneficial result occurring in each case. Generic formulas of suitable molybdenum (III), (IV), (V) and (VI) dithiocarbamates are:

$$[Mo(S-\overset{\overset{S}{\|}}{C}-NR^1R^2)_n]_m, \quad (1)$$

wherein n=3,4,5,6; m=1,2; $R^1$ and $R^2$ are either independently selected from H, alkyl groups having 1–20 carbon atoms, cycloalkyl groups having 3–22 carbon atoms and aryl groups having 6–25 carbon atoms; or $R^1$ and $R^2$ are combined in one alkylene group of the structure

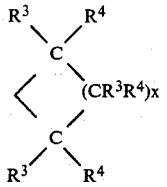

with $R^3$ and $R^4$ being independently selected from H, alkyl, cycloalkyl and aryl groups as defined above, and x ranging from 1 to 10.

$$MoO_pS_q(S-\overset{\overset{S}{\|}}{C}-NR^1R^2)_r, \quad (2)$$

wherein p=0,1,2; q=0,1,2; $(p+q)=1,2$;
r=1,2,3,4 for $(p+q)=1$ and
r=1,2 for $(p+q)=2$;

$$Mo_2O_tS_u(S-\overset{\overset{S}{\|}}{C}-NR^1R^2)_v, \quad (3)$$

wherein t=0,1,2,3,4; u=0,1,2,3,4;
$(t+u)=1,2,3,4$;
v=4,6,8,10 for $(t+u)=1$; v=2,4,6,8 for $(t+u)=2$;
v=2,4,6 for $(t+u)=3$, v=2,4 for $(t+u)=4$.

Molybdenum(V) di(tridecyl)dithiocarbamate is a particularly preferred additive.

Any suitable concentration of the molybdenum additive may be added to the hydrocarbon-containing feed stream. In general, a sufficient quantity of the additive will be added to the hydrocarbon-containing feed stream to result in a concentration of molybdenum metal in the range of about 1 to about 30 ppm and more preferably in the range of about 2 to about 10 ppm.

High concentrations such as about 100 ppm and above should be avoided to prevent plugging of the reactor. It is noted that one of the particular advantages of the present invention is the very small concentrations of molybdenum which result in a significant improvement. This substantially improves the economic viability of the process.

After the molybdenum additive has been added to the hydrocarbon-containing feed stream for a period of time, it is believed that only periodic introduction of the additive is required to maintain the efficiency of the process.

The molybdenum compound may be combined with the hydrocarbon-containing feed stream in any suitable manner. The molybdenum compound may be mixed with the hydrocarbon-containing feed stream as a solid or liquid or may be dissolved in a suitable solvent (preferably an oil) prior to introduction into the hydrocarbon-containing feed stream. Any suitable mixing time may be used. However, it is believed that simply injecting the molybdenum compound into the hydrocarbon-containing feed stream is sufficient. No special mixing equipment or mixing period are required.

The pressure and temperature at which the molybdenum compound is introduced into the hydrocarbon-containing feed stream is not thought to be critical. However, a temperature below 450° C. is recommended.

The hydrofining process can be carried out by means of any apparatus whereby there is achieved a contact of the catalyst composition with the hydrocarbon containing feed stream and hydrogen under suitable hydrofining conditions. The hydrofining process is in no way limited to the use of a particular apparatus. The hydrofining process can be carried out using a fixed catalyst bed, fluidized catalyst bed or a moving catalyst bed. Presently preferred is a fixed catalyst bed.

Any suitable reaction time between the catalyst composition and the hydrocarbon-containing feed stream may be utilized. In general, the reaction time will range from about 0.1 hours to about 10 hours. Preferably, the reaction time will range from about 0.3 to about 5 hours. Thus, the flow rate of the hydrocarbon containing feed stream should be such that the time required for the passage of the mixture through the reactor (residence time) will preferably be in the range of about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The hydrofining process can be carried out at any suitable temperature. The temperature will generally be in the range of about 150° C. to about 550° C. and will preferably be in the range of about 340° to about 440° C. Higher temperatures do improve the removal of metals but temperatures should not be utilized which will have adverse effects on the hydrocarbon-containing feed stream, such as coking, and also economic considerations must be taken into account. Lower temperatures can generally be used for lighter feeds.

Any suitable hydrogen pressure may be utilized in the hydrofining process. The reaction pressure will generally be in the range of about atmospheric to about 10,000 psig. Preferably, the pressure will be in the range of about 500 to about 3,000 psig. Higher pressures tend to reduce coke formation but operation at high pressure may have adverse economic consequences.

Any suitable quantity of hydrogen can be added to the hydrofining process. The quantity of hydrogen used to contact the hydrocarbon-containing feed stock will generally be in the range of about 100 to about 20,000 standard cubic feet per barrel of the hydrocarbon-containing feed stream and will more preferably be in the range of about 1,000 to about 6,000 standard cubic feet per barrel of the hydrocarbon-containing feed stream.

In general, the catalyst composition is utilized until a satisfactory level of metals removal fails to be achieved which is believed to result from the coating of the catalyst composition with the metals being removed. It is possible to remove the metals from the catalyst composition by certain leaching procedures but these procedures are expensive and it is generally contemplated that once the removal of metals falls below a desired level, the used catalyst will simply be replaced by a fresh catalyst.

The time in which the catalyst composition will maintain its activity for removal of metals will depend upon the metals concentration in the hydrocarbon-containing feed streams being treated. It is believed that the catalyst composition may be used for a period of time long enough to accumulate 10–200 weight percent of metals, mostly Ni, V, and Fe, based on the weight of the catalyst composition, from oils.

The following examples are presented in further illustration of the invention.

EXAMPLE I

In this example, the automated experimental setup for investigating the hydrofining of heavy oils in accordance with the present invention is described. Oil, with or without a dissolved decomposable molybdenum compound, was pumped downward through an induction tube into a trickle bed reactor, 28.5 inches long and 0.75 inches in diameter. The oil pump used was a Whitey Model LP 10 (a reciprocating pump with a diaphragm-sealed head; marketed by Whitey Corp., Highland Heights, Ohio). The oil induction tube extended into a catalyst bed (located about 3.5 inches below the reactor top) comprising a top layer of 50 cc of low surface area α-alumina (Alundum; surface area less than 1 $m^2$/gram; marketed by Norton Chemical Process Products, Akron, Ohio), a middle layer of 50 cc of a hydrofining catalyst and a bottom layer of 50 cc of α-alumina.

The hydrofining catalyst used was a fresh, commercial, promoted desulfurization catalyst (referred to as catalyst D in table I) marketed by Harshaw Chemical Company, Beachwood, Ohio. The catalyst had an $Al_2O_3$ support having a surface area of 178 $m^2$/g (determined by BET method using $N_2$ gas), a medium pore diameter of 140 Å and at total pore volume of 0.682 cc/g (both determined by mercury porosimetry in accordance with the procedure described by American Instrument Company, Silver Springs, Maryland, catalog number 5-7125-13. The catalyst contained 0.92 weight-% Co (as cobalt oxide), 0.53 weight-% Ni (as nickel oxide); 7.3 weight-% Mo (as molybdenum oxide).

The catalyst was presulfided as follows. A heated tube reactor was filled with an 8 inch high bottom layer of Alundum, a 7–8 inch high middle layer of catalyst D, and an 11 inch top layer of Alundum. The reactor was purged with nitrogen and then the catalyst was heated for one hour in a hydrogen stream to about 400° F. While the reactor temperature was maintained at about 400° F., the catalyst was exposed to a mixture of hydrogen (0.46 scfm) and hydrogen sulfide (0.049 scfm) for about two hours. The catalyst was then heated for about one hour in the mixture of hydrogen and hydrogen sulfide to a temperature of about 700° F. The reactor temperature was then maintained at 700° F. for two hours while the catalyst continued to be exposed to the mixture of hydrogen and hydrogen sulfide. The catalyst was then allowed to cool to ambient temperature conditions in the mixture of hydrogen and hydrogen sulfide and was finally purged with nitrogen.

Hydrogen gas was introduced into the reactor through a tube that concentrically surrounded the oil induction tube but extended only as far as the reactor top. The reactor was heated with a Thermcraft (Winston-Salem, N.C.) Model 211 3-zone furnace. The reactor temperature was measured in the catalyst bed at three different locations by three separate thermocouples embedded in an axial thermocouple well (0.25 inch outer diameter). The liquid product oil was generally collected every day for analysis. The hydrogen gas was vented. Vanadium and nickel contents were determined by plasma emission analysis; sulfur content was measured by X-ray fluorescence spectrometry; and Ramsbottom carbon residue was determined in accordance with ASTM D524.

The decomposable molybdenum compounds used were mixed in the feed by adding a desired amount to the oil and then shaking and stirring the mixture. The resulting mixture was supplied through the oil induction tube to the reactor when desired.

EXAMPLE II

Desolventized (stripped) extracts from a supercritical extraction of a topped (650° F.+) Hondo Californian heavy crude oil was hydrotreated in accordance with the procedure described in Example I. The metals content of the extracts is listed in Table I. The sulfur content was about 5.3–5.4 weight-%, Ramsbottom carbon residue was about 6.1–6.5 weight-% and the nitrogen content was about 0.53–0.56 weight-%. The liquid hourly space velocity (LHSV) of the oil was about 3 cc/cc catalyst/hr; the hydrogen feed rate was about 3,000 standard cubic feet (SCF) of hydrogen per barrel of oil; the temperature ranged from about 742° F. to 760° F.; and the pressure was about 2250 psig. The molybdenum compound added to the feed in Runs 2 and 4 was Molyvan® 807, an antioxidant and antiwear lubricant additive marketed by R. T. Vanderbilt Company, Norwalk, CT. Molyvan® 807 is a mixture of about 50 weight-% of molybdenum(V) di(tridecyl)dithiocarbamate and about 50 weight-% of an aromatic petroleum oil (Flexon 340; specific gravity: 0.963; viscosity at 210° F.: 38.4 SUS; marketed by Exxon Company U.S.A., Houston, TX). The Molyvan® 807 had a molybdenum content of about 4.6 weight-%. Pertinent process conditions of several runs (with and without Mo addition) are summarized in Table I.

TABLE I

| Run | Hours on Stream | LHSV | Temp Added (°F.) | PPM in Feed Mo[1] | Ni | V | Ni + V | PPM in Product Ni | V | Ni + V | % Removal % (Ni + V) |
|---|---|---|---|---|---|---|---|---|---|---|---|
| 1A | 67 | 2.88 | 727 | 0 | 67 | 133 | 200 | 17 | 29 | 46 | 77 |
| | 91 | 3.08 | 732 | 0 | 67 | 133 | 200 | 13 | 30 | 43 | 78 |
| | 115 | 2.94 | 742 | 0 | 67 | 133 | 200 | 15 | 27 | 42 | 79 |
| | 139 | 3.00 | 742 | 0 | 67 | 133 | 200 | 9 | 22 | 31 | 84[1] |
| | 163 | 2.96 | 742 | 0 | 67 | 133 | 200 | 16 | 29 | 45 | 77 |
| | 187 | 2.89 | 743 | 0 | 67 | 133 | 200 | 18 | 35 | 53 | 73 |
| | 211 | 2.89 | 742 | 0 | 67 | 133 | 200 | 16 | 30 | 46 | 77 |
| | 235 | 2.89 | 742 | 0 | 67 | 133 | 200 | 13 | 26 | 39 | 80 |
| | 259 | 2.98 | 745 | 0 | 55 | 122 | 177 | 17 | 33 | 50 | 72 |
| | 283 | 3.09 | 751 | 0 | 55 | 122 | 177 | 18 | 35 | 53 | 70 |
| | 307 | 3.01 | 760 | 0 | 55 | 122 | 177 | 16 | 32 | 48 | 73 |
| | 331 | 2.80 | 760 | 0 | 55 | 122 | 177 | 16 | 32 | 48 | 73 |
| | 392 | 3.03 | 760 | 0 | 55 | 122 | 177 | 17 | 34 | 51 | 71 |

TABLE I-continued

| Run | Hours on Stream | LHSV | Temp Added (°F.) | PPM in Feed Mo[1] | Ni | V | Ni + V | PPM in Product Ni | V | Ni + V | % Removal % (Ni + V) |
|---|---|---|---|---|---|---|---|---|---|---|---|
| 1B | 416 | 2.99 | 760 | 25 | 55 | 123 | 178 | 18 | 32 | 50 | 72 |
| | 443 | 2.98 | 760 | 25 | 55 | 123 | 178 | 18 | 33 | 51 | 71 |
| | 466 | 3.06 | 760 | 25 | 55 | 123 | 178 | 20 | 34 | 54 | 70 |
| | 490 | 3.06 | 760 | 25 | 55 | 123 | 178 | 17 | 28 | 45 | 75 |
| | 514 | 3.06 | 760 | 25 | 55 | 123 | 178 | 15 | 24 | 39 | 78 |
| | 534 | 2.99 | 759 | 25 | 55 | 123 | 178 | 16 | 23 | 39 | 78 |
| | 557 | 2.85 | 760 | 25 | 55 | 123 | 178 | 12 | 17 | 29 | 84 |
| | 581 | 2.84 | 760 | 23 | 55 | 123 | 178 | 10 | 13 | 23 | 87 |
| | 624 | 2.75 | 760 | plugging problems, run interrupted | | | | | | | |
| 1C | 806 | 3.05 | 758 | 0 | 55 | 122 | 177 | 7 | 9 | 16 | 91[1] |
| | 878 | 3.15 | 758 | 0 | 55 | 122 | 177 | 11 | 19 | 30 | 83 |
| | 926 | 3.13 | 758 | 0 | 55 | 122 | 177 | 15 | 25 | 40 | 77 |
| | 950 | 3.06 | 758 | 0 | 55 | 122 | 177 | 11 | 19 | 30 | 83 |
| 1D | 998 | 3.08 | 758 | 7 | 62 | 128 | 190 | 13 | 21 | 34 | 82 |
| | 1046 | 2.94 | 758 | 7 | 62 | 128 | 190 | 12 | 17 | 29 | 85 |
| 1E | 1094 | 2.81 | 758 | 0 | 55 | 122 | 177 | 19 | 32 | 51 | 71 |
| | 1118 | 2.88 | 758 | 0 | 55 | 122 | 177 | 16 | 26 | 42 | 76 |

[1]results believed to be erroneous

Data in Table I clearly show that dissolved Mo(V) di(tridecyl)dithiocarbamate (Molyvan® 807) was an effective demetallizing agent. The reason why the addition of this agent to the oil feed did not result in an immediate increase in the metal removal rate was probably due to the partial deactivation of the solid catalyst during control runs, which had to be first reversed by the addition of Molyvan® 807.

It is noted that, even at addition levels as low as 25 ppm Mo, plugging problems were observed after 200 hours. Thus, the addition of very small amounts of Mo (2–10 ppm) is preferred since plugging is avoided and a beneficial effect is still observed (see Run 1D).

The amount of sulfur in the product ranged from about 1.9 to about 2.1 weight-% in Run 1A, from about 1.8 to about 2.2 weight-% in Run 1B, from about 1.9 to about 2.5 weight-% in Run 1C, from about 2.6 to about 2.8 weight-% in Run 1D, and was about 3.0 weight-% in Run 1E. The amount of Ramsbottom carbon residue in the product ranged from about 3.4 to about 4.1 weight-% in Run 1A, from about 3.3 to about 3.7 weight-% in Run 1B, from about 3.5 to about 4.2 weight-% in Run 1C, from about 3.9 to about 4.4 weight-% in Run 1D, and was about 4.4 weight-% in Run 1E. The amount of nitrogen in the product ranged from about 0.42 to about 0.49 weight-% in Run 1A, from about 0.44 to about 0.46 weight-% in Run 1B, from about 0.46 to about 0.53 weight-% in Run 1C, from about 0.52 to about 0.57 weight-% in Run 1D, and was about 0.54 weight-% in Run 1E.

These results show that the Mo addition did not significantly affect the removal of sulfur, Ramsbottom carbon residue and nitrogen from the feed. However, in runs 1B and 1D with Mo addition the sulfur, Ramsbottom carbon residue and nitrogen removal activity of the catalyst generally decreased at a lesser rate than in runs without Mo, thus indicating a slight beneficial effect of the addition of Mo on the catalytic removal of sulfur, carbon residue and nitrogen.

EXAMPLE III

An Arabian heavy crude (containing about 30 ppm nickel and 102 ppm vanadium) was hydrotreated with a molybdenum carboxylate in accordance with the procedure described in Example I. The LHSV of the oil was 1.0, the pressure was 2250 psig, hydrogen feed rate was 4,800 standard cubic feet hydrogen per barrel of oil, and the temperature was 765° F. (407° C.). The hydrofining catalyst was fresh, presulfided catalyst D.

In run 2, no molybdenum was added to the hydrocarbon feed. In run 3, molybdenum(IV) octoate was added for 19 days. Then molybdenum (IV) octoate, which had been heated at 635° F. for 4 hours in Monagas pipe line oil at a constant hydrogen pressure of 980 psig (without a catalyst) in a stirred autoclave, was added for 8 days. The results of run 2 are presented in Table 11 and the results of run 3 in Table III. Both runs are outside the scope of this invention.

TABLE II

| Days on Stream | PPM Mo in Feed | (Run 2) PPM in Product Oil Ni | V | Ni + V | % Removal of Ni + V |
|---|---|---|---|---|---|
| 1 | 0 | 13 | 25 | 38 | 71 |
| 2 | 0 | 14 | 30 | 44 | 67 |
| 3 | 0 | 14 | 30 | 44 | 67 |
| 6 | 0 | 15 | 30 | 45 | 66 |
| 7 | 0 | 15 | 30 | 45 | 66 |
| 9 | 0 | 14 | 28 | 42 | 68 |
| 10 | 0 | 14 | 27 | 41 | 69 |
| 11 | 0 | 14 | 27 | 41 | 69 |
| 13 | 0 | 14 | 28 | 42 | 68 |
| 14 | 0 | 13 | 26 | 39 | 70 |
| 15 | 0 | 14 | 28 | 42 | 68 |
| 16 | 0 | 15 | 28 | 43 | 67 |
| 19 | 0 | 13 | 28 | 41 | 69 |
| 20 | 0 | 17 | 33 | 50 | 62 |
| 21 | 0 | 14 | 28 | 42 | 68 |
| 22 | 0 | 14 | 29 | 43 | 67 |
| 23 | 0 | 14 | 28 | 42 | 68 |
| 25 | 0 | 13 | 26 | 39 | 70 |
| 26 | 0 | 9 | 19 | 28 | 79 |
| 27 | 0 | 14 | 27 | 41 | 69 |
| 29 | 0 | 13 | 26 | 39 | 70 |
| 30 | 0 | 15 | 28 | 43 | 67 |
| 31 | 0 | 15 | 28 | 43 | 67 |
| 32 | 0 | 15 | 27 | 42 | 68 |

TABLE III

| Days on Stream | PPM Mo in Feed | (Run 3) PPM in Product Oil Ni | V | Ni + V | % Removal of Ni + V |
|---|---|---|---|---|---|
| | Mo (IV) octoate as Mo source | | | | |
| 3 | 23 | 16 | 29 | 45 | 66 |
| 4 | 23 | 16 | 28 | 44 | 67 |
| 7 | 23 | 13 | 25 | 38 | 71 |
| 8 | 23 | 14 | 27 | 41 | 69 |
| 10 | 23 | 15 | 29 | 44 | 67 |
| 12 | 23 | 15 | 26 | 41 | 69 |
| 14 | 23 | 15 | 27 | 42 | 68 |

TABLE III-continued

| Days on Stream | PPM Mo in Feed | (Run 3) PPM in Product Oil Ni | V | Ni + V | % Removal of Ni + V |
|---|---|---|---|---|---|
| 16 | 23 | 15 | 29 | 44 | 67 |
| 17 | 23 | 16 | 28 | 44 | 67 |
| 20 | Changed to hydro-treated Mo (IV) octoate | | | | |
| 22 | 23 | 16 | 28 | 44 | 67 |
| 24 | 23 | 17 | 30 | 47 | 64 |
| 26 | 23 | 16 | 26 | 42 | 68 |
| 28 | 23 | 16 | 28 | 44 | 67 |

Referring now to Tables II and III, it can be seen that the percent removal of nickel plus vanadium remained fairly constant. No improvement was seen when untreated or hydro-treated molybdenum octoate was introduced in run 3. This demonstrates that not all decomposable molybdenum compounds and not all treatments of decomposable molybdenum compounds provide a beneficial effect.

EXAMPLE IV

This example illustrates the rejuvenation of a hydrofining catalyst that was substantially deactivated during an extended hydrofining run essentially in accordance with the procedure of Example I. A desolventized extract of a topped (650F.+) Hondo crude was first hydrotreated for about 82 days, at about 1.5 LHSV, 2250–2350 psig, 3900 SCF $H_2$ per barrel of oil, and an inclining temperature ramp ranging from about 683° F. to about 740° F. The feed had a (Ni+V) content of about 190 ppm. During this time period the temperature was adjusted so as to provide a hydrotreated product containing about 40 ppm (Ni+V). Thus the %-removal of Ni+V was about 79%.

At the end of the first phase (82 days), the metal loading of the sulfided catalyst D was about 71 weight-% (i.e., the weight of the fresh catalyst had increased about 71% due to the accumulation of Ni and V.).

During a second phase of about 10 days, the temperature was raised from about 740° F. to about 750° F. The (NI+V) content of the pzoduct gradually increased to about 63 ppm. Thus the %-removal of (Ni+V) was only about 67% at the end of this second phase.

Then 20 ppm Mo was added in the form of Molyvan® 807, at about 750° F. During a period of about 4 days, the amount of (Ni+V) in the product dropped to about 36 ppm. Thus the %-removal of (Ni+V) was raised to about 81% (vs. 67% before the addition of Molyvan® 807).

During a fourth phase, the amount of added Molyvan® 807 was reduced to only 5 ppm Mo. The amount of (Ni+V) in the product rose slightly over a period of about 3 days to about 45 ppm, equivalent to a removal of 76% (Ni+V). It is believed that the continuous or intermittent addition of about 10 ppm Mo (as Molyvan® 807) would be sufficient to provide a desired (Ni+V) removal of about 80% for extended periods of time.

Reasonable variations and modifications are possible within the scope of the disclosure and the appended claims to the invention.

That which is claimed is:

1. A process for hydrofining a hydrocrabon-containing feed stream comprising the steps of:

introducing a decomposable molybdenum dithiocarbamate compound into said hydrocarbon-containing feed stream, wherein a sufficient quantity of said decomposable molybdenum dithiocarbamate compound is added to said hydrocarbon-containing feed stream to result in a concentration of molybdenum in said hydrocarbon-containing feed stream in the range of about 1 to about 30 ppm; and contacting said hydrocarbon-containing feed stream containing said decomposable molybdenum dithiocarbamate compound under suitable hydrofining conditions with hydrogen and a catalyst composition comprising a support selected from the group consisting of alumina, silica and silica-alumina and a promoter comprising at least one metal selected from Group VIB, Group VIIB and Group VIII of the Periodic Table, wherein the concentration of said promoter is greater than about 1 weight percent, based on the weight of said catalyst composition, when said catalyst composition is initially contacted with said hydrocarbon-containing feed stream.

2. A process in accordance with claim 1 wherein said decomposable molybdenum dithiocarbamate compound is selected from the group having the following generic formulas:

$$[Mo(S-\overset{\overset{\displaystyle S}{\|}}{C}-NR^1R^2)n]m, \quad (1)$$

wherein n=3,4,5,6; m=1,2; $R^1$ and $R^2$ are either independently selected from H, alkyl groups having 1–20 carbon atoms, cycloalkyl groups having 3–22 carbon atoms and aryl groups having 6–25 carbon atoms; or $R^1$ and $R^2$ are combined in one alkylene group of the structure

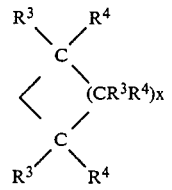

with $R^3$ and $R^4$ being independently selected from H, alkyl, cycloalkyl and aryl groups as defined above, and x ranging from 1 to 10;

$$MoO_pS_q(S-\overset{\overset{\displaystyle S}{\|}}{C}-NR^1R^2)_r, \quad (2)$$

wherein p=0,1,2; q=0,1,2; $(p+q)=1,2$;
r=1,2,3,4 for $(p+q)=1$ and
r=1,2 for $(p+q)=2$;

$$Mo_2O_tS_u(S-\overset{\overset{\displaystyle S}{\|}}{C}-NR^1R^2)_v, \quad (3)$$

wherein t=0,1,2,3,4; u=0,1,2,3,4;
$(t+u)=1,2,3,4$;
v=4,6,8,10 for $(t+u)=1$; v=2,4,6,8 for $(t+u)=2$;
v=2,4,6 for $(t+u)=3$, v=2,4 for $(t+u)=4$.

3. A process in accordance with claim 2 wherein said decomposable molybdenum dithiocarbamate compound is molybdenum (V) di(tridecyl)dithiocarbamate.

4. A process in accordance with claim 1 wherein said catalyst composition comprises alumina, cobalt and molybdenum.

5. A process in accordance with claim 4 wherein said catalyst composition additionally comprises nickel.

6. A process in accordance with claim 1 wherein a sufficient quantity of said decomposable molybdenum dithiocarbamate compound is added to said hydrocarbon-containing feed stream to result in a concentration of molybdenum in said hydrocarbon-containing feed stream in the range of about 2 to about 10 ppm.

7. A process in accordance with claim 1 wherein said suitable hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

8. A process in accordance with claim 1 wherein said suitable hydrofining conditions comprise a reaction time between said catalyst composition and said hydrocarbon-containing feed stream in the range of about 0.3 hours to about 5 hours, a temperature in the range of 340° C. to about 440° C., a pressure in the range of about 500 to about 3,000 psig and a hydrogen flow rate in the range of about 1,000 to about 6,000 standard cubic feet per barrel of said hydrocarbon-containing feed stream.

9. A process in accordance with claim 1 wherein the adding of said decomposable molybdenum dithiocarbamate compound to said hydrocarbon-containing feed stream is interrupted periodically.

10. A process in accordance with claim 1 wherein said hydrofining process is a demetallization process and wherein said hydrocarbon-containing feed stream contains metals.

11. A process in accordance with claim 10 wherein said metals are nickel and vanadium.

12. In a hydrofining process in which a hydrocarbon-containing feed stream is contacted under suitable hydrofining conditions with hydrogen and a catalyst composition comprising a support selected from the group comprising alumina, silica and silica-alumina and a promoter comprising at least one metal selected from Group VIB, Group VIIB, and Group VIII of the periodic table and in which said catalyst composition has been at least partially deactivated by use in said hydrofining process, a method for improving the activity of said catalyst composition for said hydrofining process comprising the step of adding a decomposable molybdenum dithiocarbamate compound to said hydrocarbon-containing feed stream under suitable mixing conditions prior to contacting said hydrocarbon-containing feed stream with said catalyst composition, wherein a sufficient quantity of said decomposable molybdenum dithiocarbamate compound is added to said hydrocarbon-containing feed stream to result in a concentration of molybdenum in said hydrocarbon-containing feed stream in the range of about 1 to about 30 ppm and wherein the concentration of said promoter is greater than about 1 weight percent, based on the weight of said catalyst composition, when said catalyst composition is initially contacted with said hydrocarbon-containing feed stream.

13. A process in accordance with claim 12 wherein said decomposable molybdenum dithiocarbamate compound is selected from the group having the following generic formulas:

$$[Mo(S-\overset{\overset{S}{\|}}{C}-NR^1R^2)_n]_m, \quad (1)$$

wherein n=3,4,5,6; m=1,2; $R^1$ and $R^2$ are either independently selected from H, alkyl groups having 1–20 carbon atoms, cycloalkyl groups having 3–22 carbon atoms and aryl groups having 6–25 carbon atoms; or $R^1$ and $R^2$ combined in one alkylene group of the structure

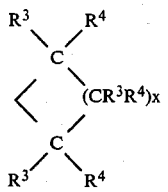

with $R^3$ and $R^4$ being independently selected from H, alkyl, cycloalkyl and aryl groups as defined above, and x ranging from 1 to 10.

$$MoO_pS_q(S-\overset{\overset{S}{\|}}{C}-NR^1R^2)_r,$$

wherein p=0,1,2; q=0,1,2; $(p+q)=1,2$;
r=1,2,3,4 for $(p+q)=1$ and
r=1,2 for $(p+q)=2$;

$$Mo_2O_tS_u(S-\overset{\overset{S}{\|}}{C}-NR^1R^2)_v, \quad (3)$$

wherein t=0,1,2,3,4; u=0,1,2,3,4;
$(t+u)=1,2,3,4$;
v=4,6,8,10 for $(t+u)=1$; v=2,4,6,8 for $(t+u)=2$;
v=2,4,6 for $(t+u)=3$, v=2,4 for $(t+u)=4$.

14. A process in accordance with claim 13 wherein said decomposable molybdenum dithiocarbamate compound is molybdenum (V) di(tridecyl)dithiocarbamate.

15. A process in accordance with claim 12 wherein said catalyst composition is a spent catalyst composition due to use in said hydrofining process.

16. A process in accordance with claim 12 wherein said catalyst composition comprises alumina, cobalt and molybdenum.

17. A process in accordance with claim 16 wherein said catalyst composition additionally comprises nickel.

18. A process in accordance with claim 12 wherein a sufficient quantity of said decomposable molybdenum dithiocarbamate compound is added to said hydrocarbon-containing feed stream to result in a concentration of molybdenum in said hydrocarbon-containing feed stream in the range of about 2 to about 10 ppm.

19. A process in accordance with claim 12 wherein said suitable hydrofining conditions comprise a reaction time between said catalyst composition and said hydrocarbon-containing feed stream in the range of about 0.1 hour to about 10 hours, a temperature in the range of 150° C. to about 550° C., a pressure in the range of about atmospheric to about 10,000 psig and a hydrogen flow rate in the range of about 100 to about 20,000 standard cubic feet per barrel of said hydrocarbon-containing feed stream.

20. A process in accordance with claim 12 wherein said suitable hydrofining conditions comprise a reaction time between said catalyst composition and said hydrocarbon-containing feed stream in the range of about 0.3 hours to about 5 hours, a temperature in the range of 340° C. to about 440° C., a pressure in the range of about 500 to about 3,000 psig and a hydrogen flow rate in the range of about 1,000 to about 6,000 standard cubic feet per barrel of said hydrocarbon-containing feed stream.

21. A process in accordance with claim 12 wherein the adding of said decomposable molybdenum dithiocarbamate compound to said hydrocarbon-containing feed stream is interrupted periodically.

22. A process in accordance with claim 12 wherein said hydrofining process is a demetallization process and wherein said hydrocarbon-containing feed stream contains metals.

23. A process in accordance with claim 22 wherein said metals are nickel and vanadium.

* * * * *